US010316709B2

(12) United States Patent
Zurface et al.

(10) Patent No.: US 10,316,709 B2
(45) Date of Patent: Jun. 11, 2019

(54) ELECTROMECHANICAL VALVE LASH ADJUSTER

(71) Applicant: Eaton Corporation, Cleveland, OH (US)

(72) Inventors: Austin Robert Zurface, Hastings, MI (US); David Gerard Genise, Marshall, MI (US); Hongbin N. Wang, Novi, MI (US); Sachin Wadikhaye, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 115 days.

(21) Appl. No.: 15/270,070

(22) Filed: Sep. 20, 2016

(65) Prior Publication Data

US 2017/0081993 A1 Mar. 23, 2017

Related U.S. Application Data

(60) Provisional application No. 62/221,275, filed on Sep. 21, 2015, provisional application No. 62/313,440, filed on Mar. 25, 2016.

(51) Int. Cl.

| | |
|---|---|
| ***F01L 1/18*** | (2006.01) |
| ***F01L 9/04*** | (2006.01) |
| ***F01L 1/22*** | (2006.01) |
| ***F01L 1/047*** | (2006.01) |
| ***F01L 1/08*** | (2006.01) |

(52) U.S. Cl.

CPC ..... *F01L 9/04* (2013.01); *F01L 1/047* (2013.01); *F01L 1/08* (2013.01); *F01L 1/182* (2013.01); *F01L 1/22* (2013.01); *F01L 2009/0455* (2013.01)

(58) Field of Classification Search

CPC ..... F01L 1/047; F01L 1/22; F01L 1/08; F01L 1/182; F01L 9/04; F01L 2009/0455

USPC ..... 123/90.39, 90.44, 90.11

See application file for complete search history.

(56) References Cited

U.S. PATENT DOCUMENTS

| | | | | |
|---|---|---|---|---|
| 3,132,636 | A | 5/1964 | Kliis | |
| 3,166,057 | A | 1/1965 | Konrad et al. | |
| 3,413,965 | A | 12/1968 | Gavasso | |
| 3,641,988 | A | 2/1972 | Torazza et al. | |
| 3,988,925 | A | 11/1976 | Seccombe et al. | |
| 4,221,199 | A | 9/1980 | Buuck et al. | |
| 4,249,488 | A | 2/1981 | Siegla | |
| 5,623,897 | A * | 4/1997 | Hampton | F01L 1/185 123/90.39 |
| 5,629,577 | A | 5/1997 | Polla et al. | |
| 6,422,187 | B2 | 7/2002 | Fischer et al. | |
| 6,827,067 | B1 | 12/2004 | Yang et al. | |
| 6,940,209 | B2 | 9/2005 | Henderson | |
| 6,973,905 | B2 | 12/2005 | Hathaway et al. | |
| 7,309,943 | B2 | 12/2007 | Henderson et al. | |

(Continued)

*Primary Examiner* — Ching Chang

(74) *Attorney, Agent, or Firm* — Paul V. Keller

(57) ABSTRACT

An internal combustion engine includes a cylinder head, a poppet valve having a seat within the cylinder head, a cam shaft on which is mounted an eccentrically shaped cam, and a rocker arm assembly comprising a rocker arm, a cam follower, and an electromagnetically actuated lash adjuster. The lash adjuster provides a continuously variable length fulcrum for the rocker arm. The actuator may be a piezo-electric stepper motor. The lash adjuster may be operative to vary a rate of internal exhaust gas recirculation and without requiring crank angle data.

20 Claims, 14 Drawing Sheets

(56) References Cited

U.S. PATENT DOCUMENTS

| | | | |
|---|---|---|---|
| 7,339,306 | B2 | 3/2008 | Henderson |
| 7,559,301 | B2 | 7/2009 | Hathaway |
| 7,761,217 | B2 | 7/2010 | Waters et al. |
| 7,786,648 | B2 | 8/2010 | Xu et al. |
| 8,059,346 | B2 | 11/2011 | Henderson |
| 8,217,553 | B2 | 7/2012 | Xu et al. |
| 9,016,252 | B2 | 4/2015 | Zurface et al. |

* cited by examiner

ELECTROMECHANICAL VALVE LASH ADJUSTER

PRIORITY

The present application claim priority from U.S. Provisional Application No. 62/221,275 filed Sep. 21, 2015 and from U.S. Provisional Application No. 62/313,440 filed Mar. 25, 2016.

FIELD

The present disclosure relates to valvetrains and methods of operating them.

BACKGROUND

In most internal combustion engines, the valves that control cylinder ports for intake and exhaust are actuated using cams mounted on a cam shaft. Rocker arm assemblies are configured to convert the rotational motion of the cams into linear motion through which the valves open and close. The cams may be shaped in view of the timing with which it is desired to have the valves open and close.

The rocker arm assemblies form force transmission pathways between the cams and the valves. Valve lash is a gap or clearance that occurs within one of those pathways over the course of cam shaft rotation. There may be an optimal or preferred amount of lash. Too little lash may result in valve leakage or damage to moving parts. Too much lash may result in improper timing, noise, or excessive wear.

A variety of factors may affect lash. Among those factors are manufacturing tolerances, thermal expansion, and wear. In view of those factors, most engines include means for adjusting valve lash. In some engines, the lash adjustment means is designed for manual lash adjustment to be performed after assembly and again later during maintenance. Other engines use hydraulic lash adjusters that adjust lash automatically and dynamically while the engines are operating.

SUMMARY

The present teachings relate to an internal combustion engine that includes a cylinder head, a poppet valve having a seat within the cylinder head, a cam shaft on which is mounted an eccentrically shaped cam, and a rocker arm assembly comprising a cam follower. The cam follower may be positioned to engage and follow the cam as the cam shaft rotates. The rocker arm assembly may form a force transmission pathway through which force from the cam is transmitted to actuate the poppet valve.

According to some aspects of the present teachings, the rocker arm assembly includes an electromechanical lash adjuster operable to control lash in the force transmission pathway. In some of these teachings, the rocker arm assembly includes a rocker arm and the electromechanical lash adjuster provides a fulcrum for the rocker arm. The electromechanical lash adjuster includes a variable length structure that determines a spacing between the fulcrum and the cylinder head. The lash adjuster has an electromechanical actuator operable to vary the length of the structure and thereby control lash. In some of these teachings, the length of the structure is continuously variable over a range of adjustment. In some of these teachings, the variable length structure is the entire lash adjuster. An electromechanical lash adjuster as described herein may provide a lower compliance as compared to a hydraulic lash adjuster. The improved stiffness in the valvetrain may improve valve timing. The design may be very compact.

In some of these teachings, the actuator is housed within an outer body of the lash adjuster. The outer body of the lash may be cylindrical or nearly cylindrical. In some of these teachings, the actuator is an electromagnetic motor. Housing an electromagnetic motor within the outer body of the lash adjuster may protect the actuator from metal particles suspended in oil in the surrounding environment.

According to some aspects of the present teachings, the electromechanical lash adjuster includes two parts that interface through one or more surfaces that are angled such that rotation of one of the parts about an axis while the other part is prevented from rotating causes a linear displacement between the two parts along the axis. The electromechanical actuator may be configured to drive the rotation and the electromechanical lash adjuster may be operative as a linear actuator that varies the spacing between the fulcrum and the cylinder head in relation to the rotation. In some of these teachings, the interface between the two parts is formed through an angled end surface of one or the other part. The two parts may interface end-to-end. In some others of these teachings, the two parts interface through helical threads on one or both parts. In some of these teachings, the electromechanical actuator comprises an electromagnetic motor. The motor may have a spindle configured to drive the rotation. In some of these teachings, the spindle is parallel to, but offset from, the axis about which the part rotates. The motor may be housed within an outer body of the lash adjuster. The motor may drive a pinion gear that meshes with a larger gear that is fixed to the rotating part. These structural features lend themselves to forming a low cost, low compliance, compact, electro-mechanical lash adjuster that has a high load bearing capacity while employing a small actuator.

In some aspects of the present teachings, the electromechanical lash adjuster includes first, second, and third parts and the electromechanical actuator is configured to rotate the second part about an axis and relative to the first and third parts. The second part interfaces with the first part through one or more angled surfaces and with the third part through one or more other angled surfaces. The angles of these surfaces are such that rotation of the second part about the axis while the first and third part are prevented from rotating causes a linear displacement between each pair of parts along the axis. In some of these teachings, the second part has two sets of threads, one having opposite threading (left versus right-hand) from the other. One set of threads may form the interface with the first part and the other the interface with the third part. The second part may include an internally and externally threaded. An electromechanical actuator may be configured to drive rotation of the second part relative to the first and third parts. This relative rotation may cause the third part to extend or retract relative to the first part. This structure may facilitate load bearing by the lash adjuster and may provide leverage for the actuator. Also, lash adjustment may be carried out without relative rotation between the ends of the lash adjuster. In some of these teachings, lash adjustment is carried out without rotation of an end of the lash adjuster on which the rocker arm pivots. In some of these teachings, the two sets of threads on the second part have differing pitches. Varying the pitches of the threads provides a means to control the amount of length adjustment that occurs per unit actuator movement.

In some of these teachings, the actuator comprises an electric motor that is positioned above a rocker arm for which the electromechanical lash adjuster provides a fulcrum. In some of these teachings a part of the lash adjuster, which may be a part coupled to the electric motor, passes through an opening in the rocker arm. In some of these teachings, the electric motor is held in a fixed position relative to the cylinder head.

A gear set may be provided between an electric motor and a threaded part driven by the motor. In some of these teachings, a gear ratio between the electric motor and a part it drives is ten to one or greater. In some of these teachings, the gear ratio is about 25 to one or greater. In some of these teachings, the gear set includes a planetary gear set. The planetary structure may allow the gears to be very compact. A high gear ratio allows the use of a smaller motor and may stiffen the lash adjuster.

According to some aspects of the present teachings, the electromechanical actuator is a linear actuator extensible between a first end and a second end thereof. As the term is used here, a linear actuator is a device that is operative to linearly extend a contact surface while applying a force in the direction of extension. Rotation that accompanies the linear extension is not inconsistent with this definition, although in some of these teachings the contact surface extends without rotation. In some of these teachings, the contact surface is a surface on which a rocker arm pivots.

According to some aspects of the present teachings, the electromechanical actuator includes a piezoelectric drive element. In some of the teachings, the actuator is an amplified piezo actuator. In some of these teachings, the actuator is a piezoelectric stepper motor. In some of these teachings, the actuator is a SQUIGGLE® motor such as the motor described in U.S. Pat. No. 7,309,943, which is incorporated herein by reference. A piezoelectric actuator may operate without creating magnetic fields that could attract metal particles suspended in oil. Attraction of such particles could interfere with the operation of a lash adjuster.

In some of these teachings, the actuator includes a piezoelectric stepper motor that requires at least 100 cycles to travel through the range of adjustment provided by the lash adjuster. In some of these teachings, the stepper motor requires at least 1000 cycles to travel through the range of adjustment. The range of adjustment may be on the order of 3 mm. Requiring a large number of steps to cover the range of motion provides precision and allows the use of smaller piezoelectric elements.

According to some aspects of the present teachings, the electromechanical actuator joins two parts with threaded engagement and is operative through a vibratory mechanism. In a vibratory mechanism, one of the parts is induced to vibrate in two modes. The vibrations may be induced by two or more piezoelectric elements. The vibrations may be at or near a resonant frequency of the actuator. The two modes of vibration may be 90 degrees out of phase. The vibrations may be effective to cause an area of contact between the engaged threads to rotate about an axis, creating torque between the engaged parts and inducing relative rotation. The phase relationship of the two modes of vibration may be changed to alter the direction of relative rotation.

In some of these teachings, the lash adjuster includes two parts selectively joined by an actuator. The two parts may be movable relative to one another to provide the variable length structure through which lash is controlled. In some of these teachings, the two parts are telescopically engaged. The actuator may include an electromechanical locking element operative to selectively restrain telescoping of the two parts. The actuator may release engagement to adjust lash and may engage the two parts to maintain the length of the variable length structure.

In some of these teachings, the electromechanical lash adjuster is operable over a range of extension through which it resists compression along its length primarily through friction. In some of these teachings, the electromechanical lash adjuster is structured whereby the friction force that resist compression increases as load on the electromechanical lash adjuster increases. In some of these teachings, struts connecting two telescoping parts in a lash adjuster are angled relative to the direction of telescoping, whereby a portion of a compressive force on the lash adjuster is translated into a radial force that increases friction between the two telescoping parts.

According to some aspects of the present teachings, the electromechanical lash adjuster is operable according to a clamp-extend-clamp-retract mechanism. An actuator operable according to these teachings may include two electromechanical locking elements spaced apart and joined by a structure that is variable in length. The locking elements may be piezoelectric devices. The connecting structure that is variable in length may also be a piezoelectric device. The actuator may be operative to vary the length of a fulcrum or other part provided by the lash adjuster by keeping the first locking element engaged while disengaging the second locking element, extending or contracting the connecting element to create extension or contraction between the two locking elements, engaging the second locking element, disengaging the first locking element, reversing the extension or contraction of the connecting element, then reengaging the first locking element. This process may allow the actuator to travel along the length of one of the two parts and vary the length of a fulcrum with locomotion similar to that employed by an inchworm.

According to some aspects of the present teachings, valve timing is adjusted, over a significant range by varying lash. This variation may increase or decrease an amount of overlap between intake and exhaust valve opening and control an amount of internal exhaust gas recirculation. The cam may be shaped to accommodate this mode of valve timing variation. In some of these teachings, the cam shapes allow the amount of overlap to be varied over a substantial range without significantly changing the opening velocities of the valves. In some of these teachings, the amount of overlap may be varied over the range without significantly changing the closing velocities of the valves. In some of these teachings, the amount of overlap may be varied over the range without significantly changing the rate of acceleration of the valves as they begin to open. In some of these teachings, the amount of overlap may be varied over the range without significantly changing the rate of deceleration of the valves as they approach closing. In some of these teachings, the amount of overlap is varied in relation to the engine's operating regime. The engine operating regime may relate to one or more of torque, speed, temperature, and/or other factors. In some of these teachings, the amount of overlap is varied without input from an engine control unit (ECU). In some of these teachings, the amount of overlap is varied based on engine speed and or temperature.

According to some aspects of the present teachings, the rocker arm assembly comprises a first rocker arm for which the electromechanical lash adjuster provides a fulcrum and an auxiliary rocker arm pivotally linked to the first rocker arm at a joint proximate the fulcrum. The auxiliary rocker arm may be configured to reduce stress on the electromechanical lash adjuster in a direction orthogonal to that in which the lash adjuster is extensible. In some of these teachings, the first rocker arm extends from the joint in the direction of the cam follower and the auxiliary rocker arm extends from the joint in the opposite direction. In some of these teachings, the auxiliary rocker arm has an end distal from the joint and the distal end is pivotally mounted at a position that is substantially fixed relative to the cylinder head. In some of these teachings, the auxiliary rocker arm is pivotally mounted to a cam carrier.

In some of these teaching, the electromechanical actuator is in a load bearing position within the rocker arm assembly. In some of these teaching, the electromechanical actuator is in a load bearing position under the fulcrum provided by the lash adjuster. Placing the electromechanical actuator in a load-bearing position may facilitate the use of that actuator to provide feedback for control or diagnostic purposes. An electromechanical actuator in a load bearing position may also be operative as a generator. In some of these teachings, an actuator in a load-bearing position is operated to provide vibration control.

According to some aspects of the present teachings, the electromechanical lash adjuster includes a controller. In some of these teachings, the controller is independent from the ECU. In some of these teachings, the controller is operative without crank angle data. In some of these teachings, the controller implements a control algorithm based on measurements that relate to the fraction of time that a cam is applying a force to the rocker arm assembly. In some of these teachings, the data used by the algorithm is provided by detecting when a load greater than a threshold value is applied to the fulcrum. In some of these teachings the load is detected by sensing force or pressure. In some of these teachings, the force is sensed by the actuator. In some of these teachings, the force is detected through a resulting displacement of the poppet valve. The controller may compare the two inputs and adjust the lash accordingly. In some of these teachings, the comparison involves determining a fraction of the cam cycle over which the cam is applying the force to the rocker arm assembly. In some of these teachings, the comparison involves determining a ratio between the length of the cam cycle over which the cam is applying the force and the length of the cam cycle over which the cam is not. The lash may be adjusted to cause the result of one of these determinations to approach a target value or to keep it within a target range.

According to some aspects of the present teachings, the lash is not adjusted with the cam follower contacting a base circle portion of the cam. Operation of the actuator to adjust lash may cease before the cam follower has come in contact with the cam. In some of these teachings, the cam does not include a base circle structure. The absence of a base circle structure allows the cam to be smaller and lighter and means the cam follower does not contact the cam throughout much of the cam cycle, which reduces friction and may improve fuel economy. Automatic and dynamic lash adjustment without requiring the cam follower to contact the cam at a base circle position may be accomplished by one of the methods described herein.

According to some aspects of the present teachings, the actuator includes a servomotor. A servomotor is a motor that may be operative to actuate to a particular position in response to a command to move to that position. In some of these teachings, the motor action is disabled during a period when the cam may be applying substantial force to the rocker arm assembly. A servomotor may lend itself to making rapid adjustments of the lash toward a desired setting.

According to some aspects of the present teachings, the actuator includes a stepper motor. A stepper motor may be operative to move one or a whole number of unit distances (steps) in response to commands. A stepper motor may provide a high degree of positional stability and may simplify control. A stepper motor may also have a low sensitivity to variations in its power supply. According to some aspects of the present teachings, the lash adjuster is operative to maintain its position under load without power being supplied to the actuator.

According to some aspects of the present teachings, a component of the rocker arm assembly further comprises a component that is operative to sense a force in proportion to a force applied by the cam to the rocker arm assembly. In some of these teachings, the actuator consumes power to maintain the lash and the power consumption is monitored to sense the load. In some of these teachings, the rocker arm assembly comprises a load cell that is distinct from the actuator. In some of these teachings, the actuator comprises a piezoelectric element in a position to detect load on the lash adjuster. The load sense may be used to control the lash as described elsewhere herein.

According to some aspects of the present teachings, the electromechanical lash adjuster includes a sensor or is operative as a sensor. In some of these teachings, the sensor is operative to sense a displacement of the valve or a component of the rocker arm assembly. The sensor may be used to control the lash as described elsewhere herein. In some of these teachings, the displacement sensor is a Hall effect sensor, although other types of displacement sensors may be used instead.

In some of these teachings, a sensing functionality used to control lash is also used to detect wear. For example, wear of bearings or valve seats in the rocker arm assembly may be detected by the electromechanical lash adjuster. This diagnostic information may be reported to an engine control unit. In some of these teaching, the sensing functionality may be used to detect vibrations.

According to some aspects of the present teachings, the electromechanical lash adjuster is operable to dampen vibrations in the rocker arm assembly. In some of these teachings, the electromechanical actuator is operated to induce cyclic movement of the lash adjuster with a timing selected to dampen vibrations in the rocker arm assembly. In some of these teachings, a current to a piezoelectric actuator is varied according to a periodic function that has the effect of dampening vibrations.

Another aspect of the present teachings is a method of operating an internal combustion engine. According to the method, two points in the cam cycle are detected. A first point relates to when the cam begins applying a force to the rocker arm assembly or inducing a displacement in the rocker arm assembly. A second point relates to when the cam ceases applying the force or inducing the displacement. The elapsed times between these points and successive occurrences of these points may be compared and the lash is adjusted on the basis of the comparison. In some of these teachings, the comparison involves the ratio between the length of the period over which the force or displacement is being applied to the rocker arm assembly and the length of the period over which it is not. In some of these teachings, the comparison involves the fraction of the cam cycle over which the force or displacement is being applied to the rocker arm assembly. Either of these parameters may be determined without knowledge of the crank angle. Accordingly, these methods lend themselves to a lash adjuster that is operative without data from an ECU.

A lash adjuster according to the present teachings may require little power for actuation. According to some aspects of the present teachings, the actuator is powered with energy produced by a generator that is mounted to the electromechanical lash adjuster. In some of these teachings, a controller for the actuator is also powered by the generator. A lash adjuster-mounted generator may be operative to convert mechanical energy into electricity. Providing a generator as part of the lash adjuster may reduce or eliminate the need to run wires to the lash adjuster. In some of these teachings, the generator is configured to be driven by force from the cam shaft transmitted through the rocker arm assembly. In some of these teachings, the generator is configured to be driven by vibrations of the electromagnetic lash adjuster. In some of these teachings, the generator is an electromagnetic generator. In some of these teachings, the generator is a piezoelectric generator. In some of these teachings, the generator includes a piezoelectric element that is also a part of the actuator.

The primary purpose of this summary has been to present certain of the inventors' concepts in a simplified form to facilitate understanding of the more detailed description that follows. This summary is not a comprehensive description of every one of the inventors' concepts or every combination of the inventors' concepts that can be considered "invention". Other concepts of the inventors will be conveyed to one of ordinary skill in the art by the following detailed description together with the drawings. The specifics disclosed herein may be generalized, narrowed, and combined in various ways with the ultimate statement of what the inventors claim as their invention being reserved for the claims that follow.

BRIEF DESCRIPTION OF THE DRAWINGS

Spatially relative terms, such as "beneath," "below," "lower," "above," "upper" and the like are used in the following detailed description to describe spatial relationships as illustrated in the drawings. Those relationships are independent from the orientation of any illustrated device in actual use.

DETAILED DESCRIPTION

Figure 1A:
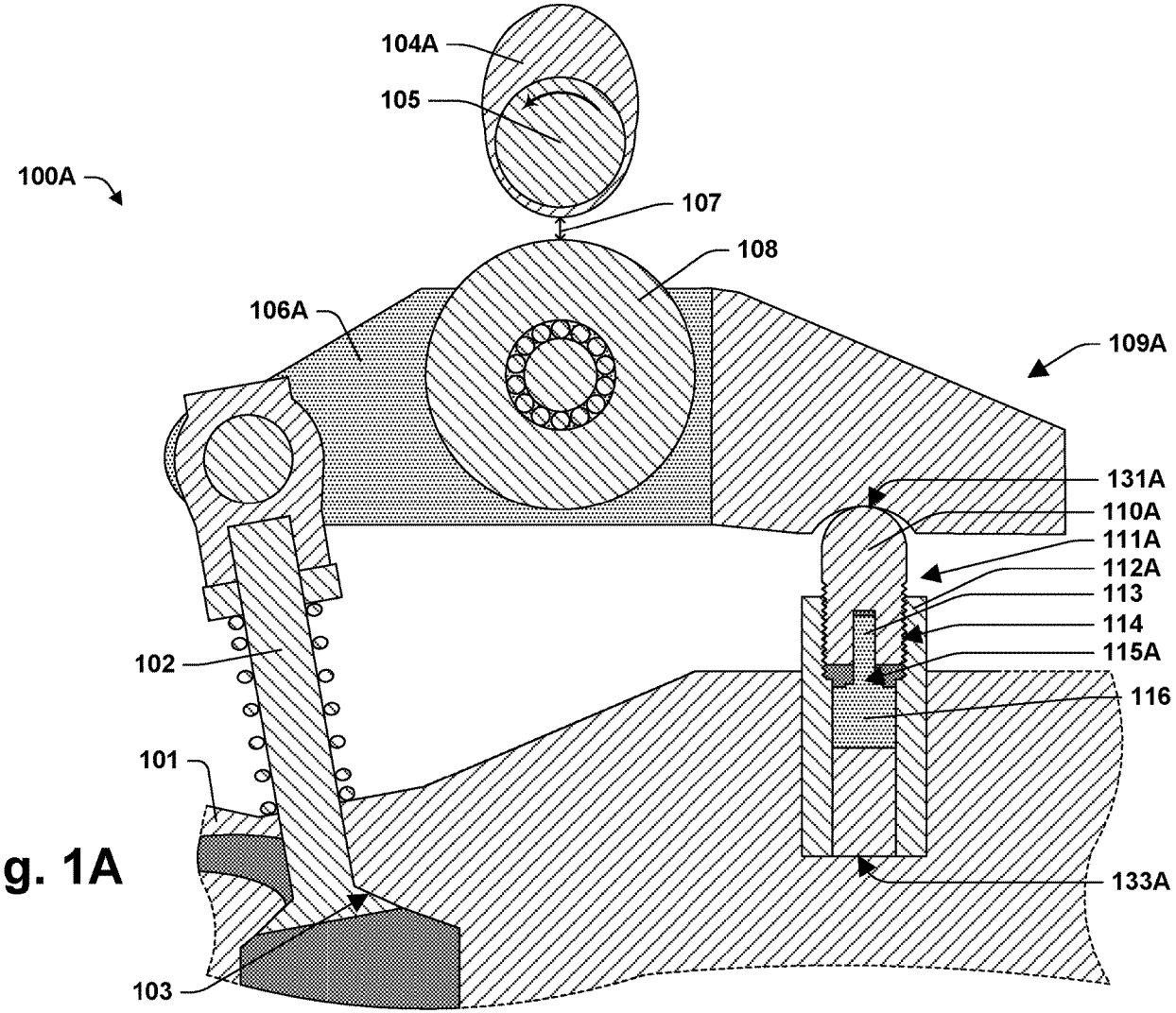
FIG. 1A is a partial cutaway side view of an internal combustion engine according to some aspects of the present teachings.

In the drawings, some reference characters consist of a number followed by a letter. In this description and the claims that follow, a reference character consisting of that same number without a letter is equivalent to a listing of all reference characters used in the drawings and consisting of that same number followed by a letter. For example, "engine 100" is the same as "engine 100A, 100B, 100C, 100D". Engine 100 is therefore a generic reference that includes the specific instances engine 100A, engine 1006, etcetera. Where options are provided for one instance subject to a generic reference, those options are to be given consideration in connection with all instances subject to that generic reference.

FIG. 1 provides a partial cutaway side view of an internal combustion engine 100A according to some aspects of the present teachings. The view includes a portion of a cylinder head 101, a poppet valve 102 having a seat 103 within cylinder head 101, an eccentrically shaped cam 104A mounted on a cam shaft 105, and a rocker arm assembly 109A. Rocker arm assembly 109A includes a rocker arm 106A, an electromechanical lash adjuster 111A, and a cam follower 108. Cam follower 108 is mounted to rocker arm 106A and is positioned to engage and follow cam 104A as cam shaft 105 rotates. Cam follower 108 is a roller follower, although another type of cam follower such as a slider could be used instead.

Rocker arm assembly 109A forms a force transmission pathway through which force from cam 104A may be transmitted to actuate poppet valve 102. Lash 107 occurs in this force transmission pathway. Lash 107 is illustrated as occurring between cam 104A and cam follower 108, but may occur elsewhere in the force transmission pathway such as between rocker arm 106A and poppet valve 102.

Electromechanical lash adjuster 111A is extensible between a first end 131A and a second end 133A thereof. First end 131A provides a fulcrum on which rocker arm 106A pivots. Electromechanical lash adjuster 111A includes an electromechanical actuator 115A operable to vary the length of lash adjuster 111A, which the distance between first end 131A and second end 133A. Adjusting the length of electromechanical lash adjuster 111A varies the height of first end 131A above cylinder head 101 and thereby controls lash 107. Electromechanical actuator 115A is operable to continuously vary the length of electromechanical actuator 115A while engine 100A is operating, although lash adjustment may be prevented when cam 104A is loading rocker arm assembly 109A.

Electromechanical lash adjuster 111A includes an upper part 110A and a lower part 112A. Lower part 112A is nearly cylindrical and provides an outer body for lash adjuster 111A. Electromechanical actuator 115A is housed within that outer body. In conjunction with upper part 110A, lower part 112A protects electromechanical actuator 115A from metal particles in oil that may be dispersed throughout the environment surrounding lash adjuster 111A. The metal particles might otherwise be attracted by magnetic components of electromechanical actuator 115A and interfere with its operation.

Figure 1B:
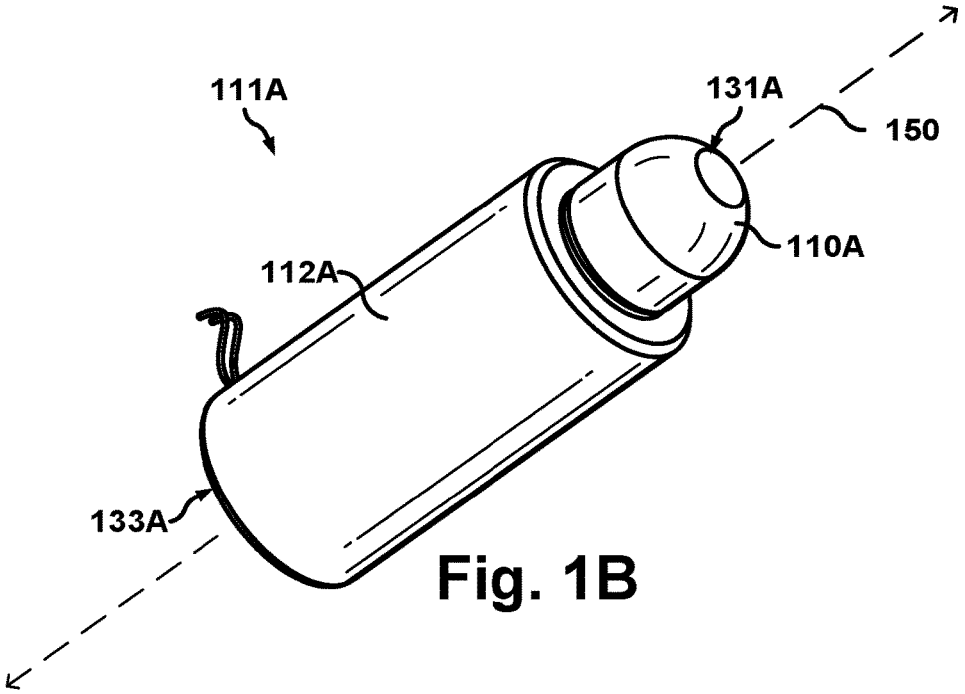
FIG. 1B is a perspective view of an electromechanical lash adjuster according to some aspects of the present teachings in a retracted configuration.
Figure 1C:
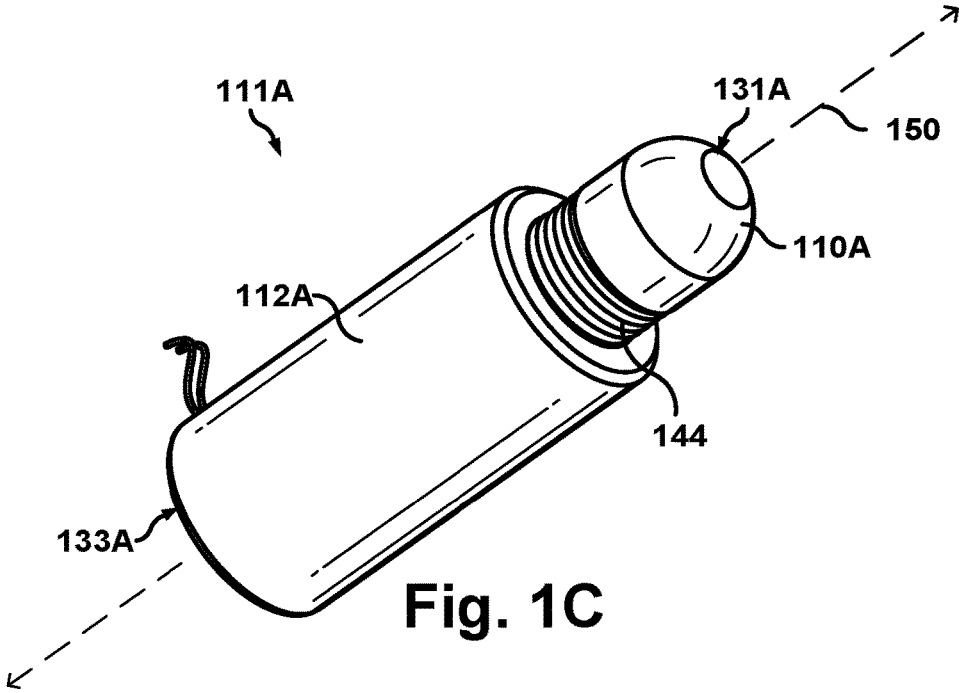
FIG. 1C is a perspective view of the electromechanical lash adjuster of FIG. 1B in an extended configuration.

FIG. 1B provides a perspective view of electromechanical lash adjuster 111A in a retracted configuration while FIG. 1C provide the same view after actuation to a more extended configuration. Upper part 110A and lower part 112A interface through helical threads 114. Threads 114 are pitched, and therefore angled, such that rotating part 110A about its axis 150 while part 112A is prevented from rotating about axis 150 results in relative rotation between these parts, causes a linear displacement between upper part 110A lower part 112A, extends or contracts lash adjuster 111A depending on the direction of relative rotation, and raises or lowers the height of fulcrum 131A over cylinder head 101 thereby adjusting lash 107.

Upper part 110A may be, in part, an externally threaded shaft while lower part may be, in part, an internally threaded tube. Electromechanical lash adjuster 111A is continuously variable in length by relative rotation between upper part 110A and lower part 112A. Electromechanical actuator 115A includes an electromagnetic motor 116 that is coaxial with upper part 110B and lower part 112B. Operation of electromagnetic motor 116 may be controlled through a controller (not shown). The controller may be an engine control unit (ECU) or a separate controller associated with lash adjuster 111A FIGS. 2A-2D show a different electromechanical lash adjuster 111B that may be used in engine 100 in place of electromechanical lash adjuster 111A. Lash adjuster 111B includes an upper part 110B, a lower part 112B, and an intermediate part 131B. Intermediate part 131B has internal threads 124 formed on an inner surface 126 and external threads 123 formed on its outer surface. Internal threads 124 and external threads 123 having opposite orientations, one set being left-hand threads and the other being right-hand threads. Intermediate part 131B may be considered a tube. Internal threads 124 may engage external threads 122 of upper part 110B. External threads 123 may engage internal threads 125 of lower part 112B. These threads provided angled surfaces through which these parts interface. Relative rotation between upper part 110B and lower part 112B may be prevented by an anti-rotation guide 135B, which is mounted to lower part 112B and travels within a slot 132B in upper part 110B. Motor 116 may be housed within, and fixed to prevent rotation with respect to, lower part 112B. A shaft 121 of motor 116 may be coaxial with threads 122, 123, 124, and 125 and have a non-circular cross-section, e.g. D-shaped, that mates with an opening 120 in intermediate part 131B allowing motor 116 to drive rotation intermediate part 131B.

Figure 2B:
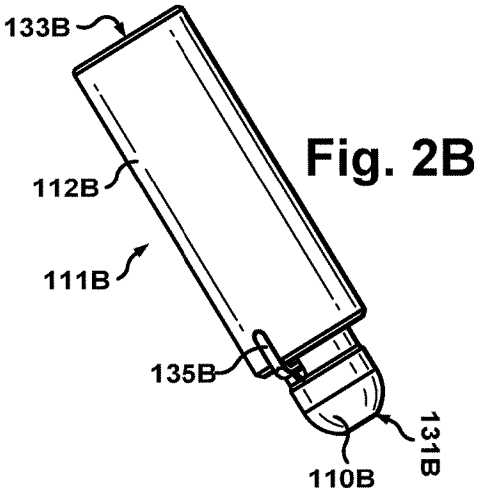
FIG. 2B is a perspective view of the electromechanical lash adjuster of FIG. 2A.
Figure 2D:
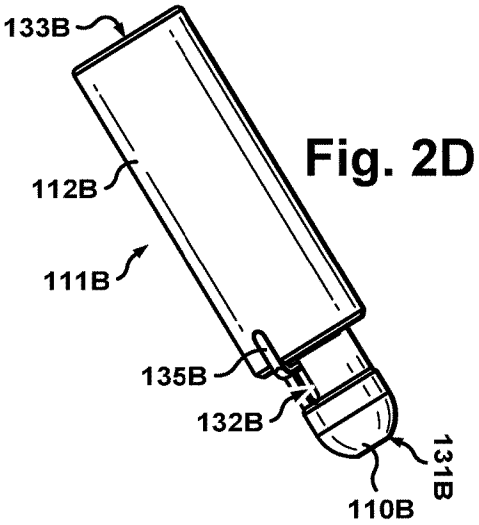
FIG. 2D is a perspective view of the electromechanical lash adjuster of FIG. 2C.
Figure 2A:
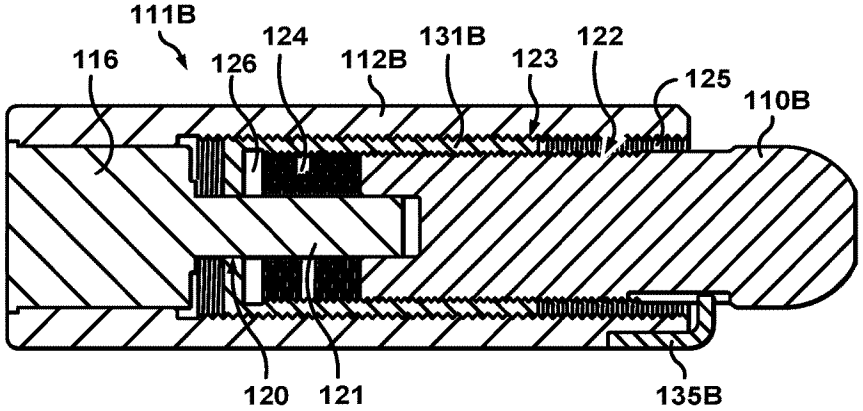
FIG. 2A is a cross-sectional view of an electromechanical lash adjuster according to some aspects of the present teachings in a retracted configuration.
Figure 2C:
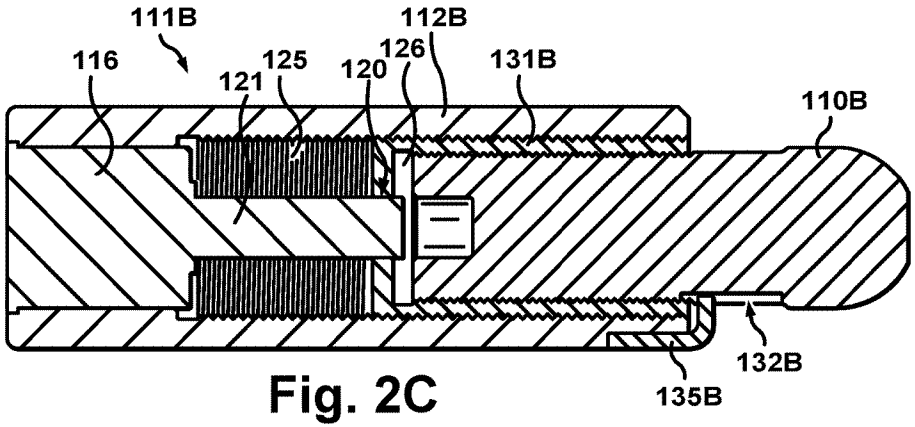
FIG. 2C is a cross-sectional view of the electromechanical lash adjuster of FIG. 2A in an extended configuration.

FIGS. 2A and 2B provide cross-sectional and perspective views of lash adjuster 111B in a retracted configuration. FIGS. 2C and 2D provide corresponding views with lash adjuster 111B in a relatively more extended configuration. Motor 116 is operative to actuate lash adjuster 111B between these configurations by rotating shaft 121. The rotation of intermediate part 131B by motor 116 results in linear displacement between intermediate part 131B and each of parts 110B and 112B. Moreover, the rotation causes a linear displacement between parts 110B and 112B, which varies the length of lash adjuster 111B, which is characterized by a distance between its first end 131B and its second end 133B.

Internal threads 124 and external threads 123 may have differing pitches. The ratio between rotations of shaft 121 and units of extension of lash adjuster 111B may be controlled by varying the pitch of threads 122 and 124 and/or the pitch of threads 123 and 125. For example, internal threads 124 may have a pitch of about 0.2 mm and external threads 123 may have a pitch of about 0.3 mm.

Figure 3:
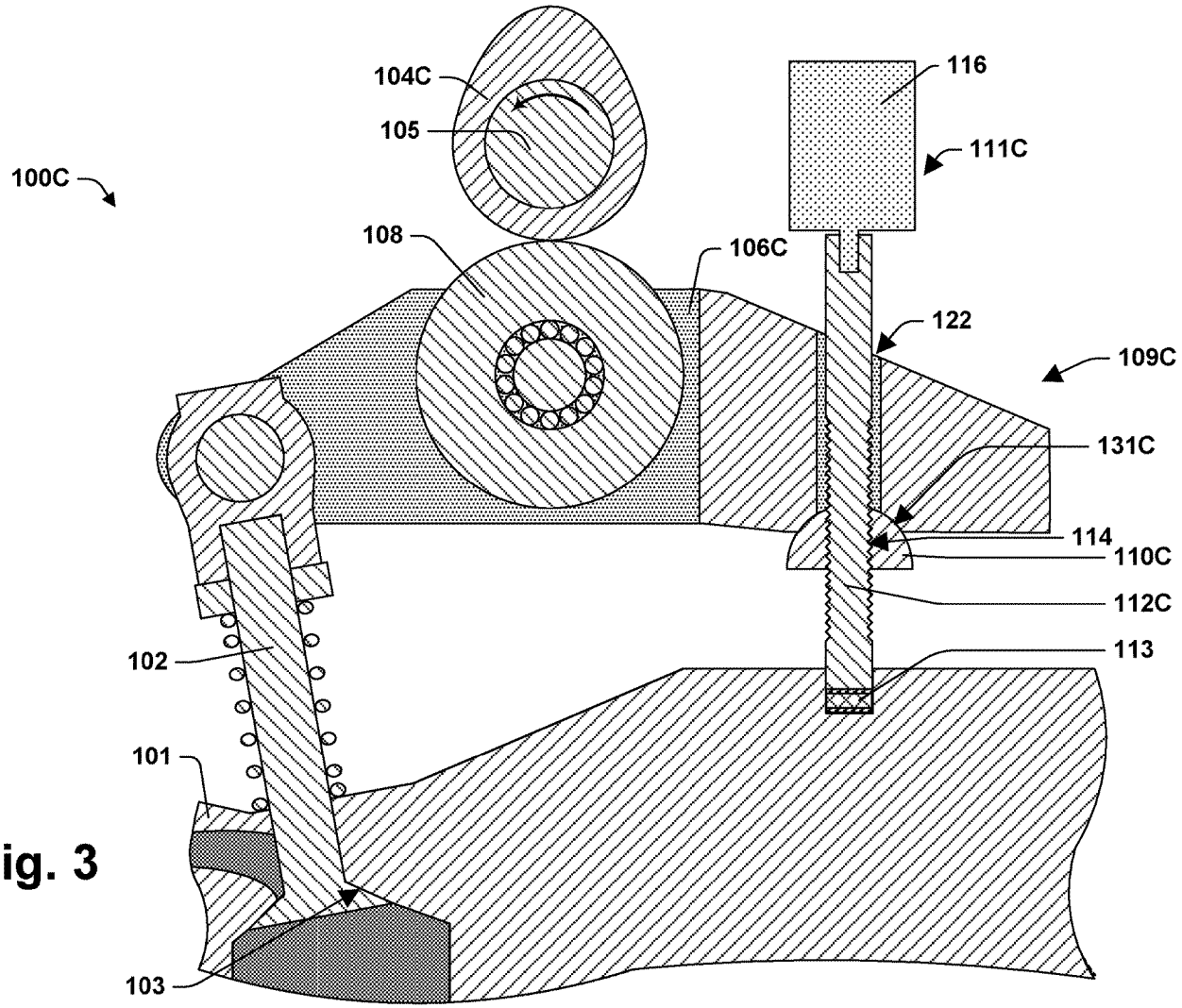
FIG. 3 is a partial cutaway side view of an internal combustion engine according to some other aspects of the present teachings.

FIG. 3 illustrates an engine 100C having an electromechanical lash adjuster 111C Lash adjuster 111C includes a shaft 112C and a ball 110C engaged by threads 114. Rocker arm 106C pivots on a rounded upper surface of ball 110C, which provides a fulcrum 131C for rocker arm 106C. The upper surface may be cylindrical or have another suitable shape such that engagement between ball 110C and rocker arm 106C may prevent rotation of ball 110C. Motor 116 may be mounted above rocker arm 106C in a position that is fixed with respect to cylinder head 101.

If ball 110C is prevented from rotating relative to rocker arm 106C, rotation of shaft 112C by motor 116 may cause ball 110C to travel along shaft 112C, raising or lowering the fulcrum 131C for rocker arm 106C and thereby adjusting lash. Shaft 112C may pass through an opening 122 in rocker arm 106C that allows motor 116 to be mounted above rocker arm 106C. Motor 116 may be mounted to a cam carrier (not shown) or any part that is held in a fixed position relative to cylinder head 101. Shaft 112C may rest atop a load cell 113, which may provide information useful for diagnostics or control.

Figure 4A:
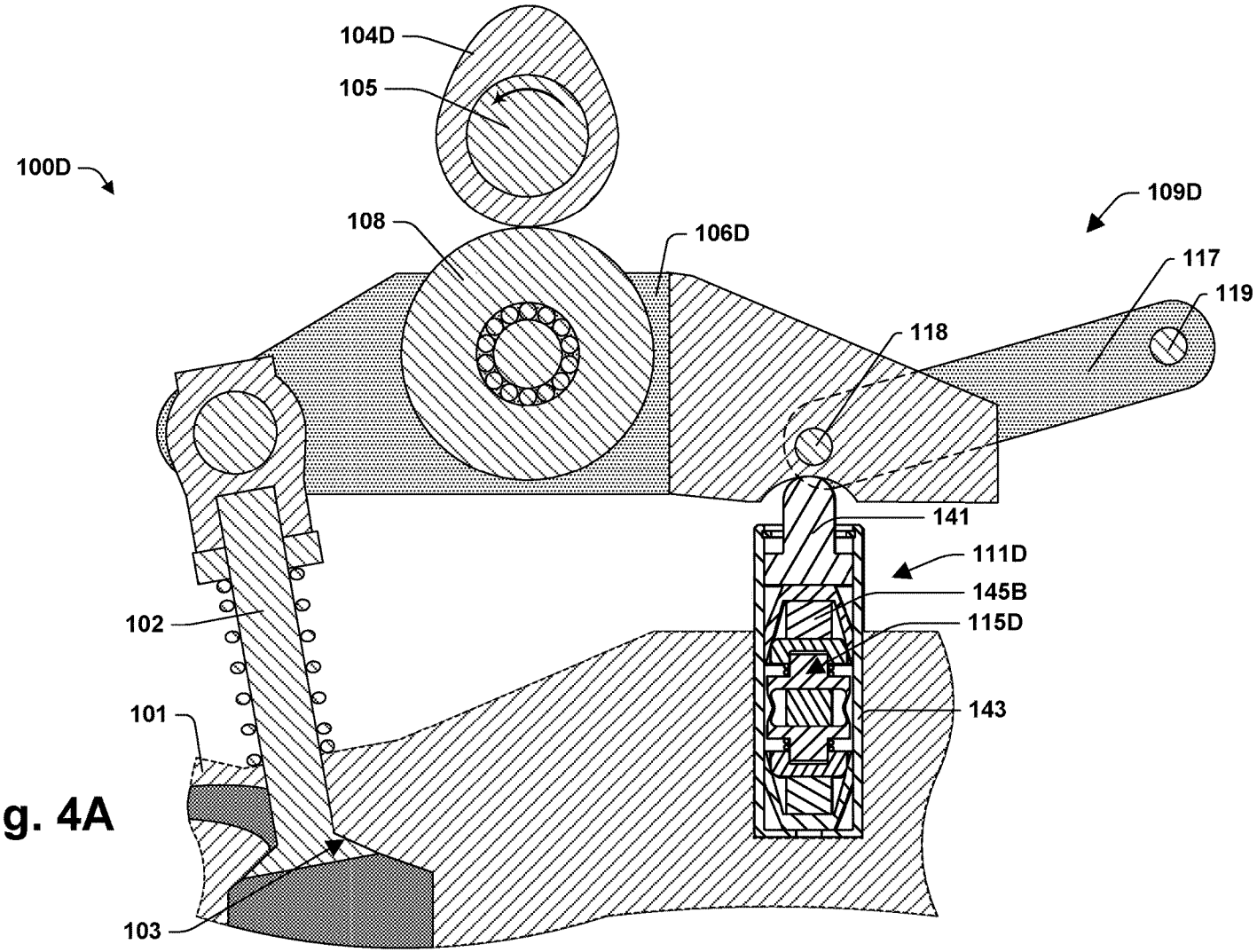
FIG. 4A is a partial cutaway side view of an internal combustion engine according to some other aspects of the present teachings.

FIG. 4A provides a partial cross-section of an engine 100D having a rocker arm assembly 109D. Rocker arm assembly 109D includes a rocker arm 106D and an electromechanical lash adjuster 111D. Lash adjuster 111D provides a fulcrum for rocker arm 106D. Lash adjuster 111D is operative as a linear actuator to vary the spacing between that fulcrum and cylinder head 101. Lash adjuster 111D includes an upper part 141 and a lower part 143, which are telescopically engaged, whereby upper part 141 can slide relative to lower part 143 making the length of lash adjuster 111D continuously variable. Upper part 141 and lower part 143 are joined by an electromechanical actuator 115D, which is a piezoelectric stepper motor operable through a clamp-extend, clamp-retract mechanism. Upper part 141 provides an outer body for lash adjuster 111D and houses electromechanical actuator 115D.

Rocker arm assembly 109D further includes a pair of auxiliary rocker arms 117 flanking rocker arm 106D and pivotally connected at one end to rocker arm 106D through axle 118, which provides a joint proximate the fulcrum. The distal ends of auxiliary rocker arms 117 may be pivotally mounted on an axle 119. Axle 119 may be mounted to a cam carrier (not shown) or other position fixed relative to cylinder head 101. Auxiliary rocker arms 117 may be positioned to mitigate off axis forces that might otherwise act against lash adjuster 111D as cam 104D actuates valve 102. In this example, off axis forces are force orthogonal to the direction in which lash adjuster 111D extends to adjust lash.

Figure 4C:
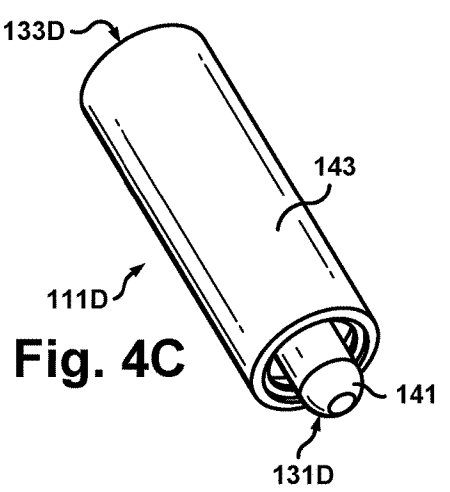
FIG. 4C is a perspective view of the electromechanical lash adjuster of FIG. 4B.
Figure 4E:
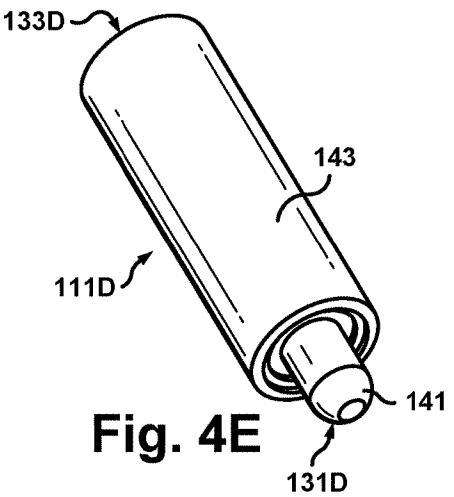
FIG. 4E is a perspective view of the electromechanical lash adjuster of FIG. 4D.
Figure 4B:
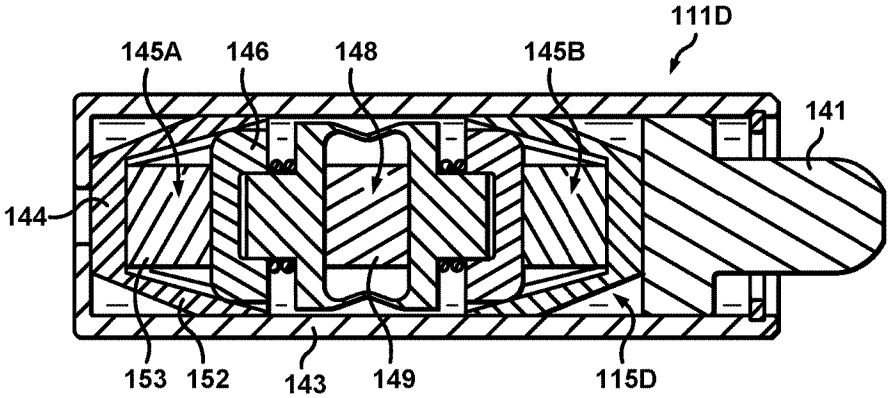
FIG. 4B is a cross-sectional view of an electromechanical lash adjuster according to some aspects of the present teachings in a retracted configuration.
Figure 4D:
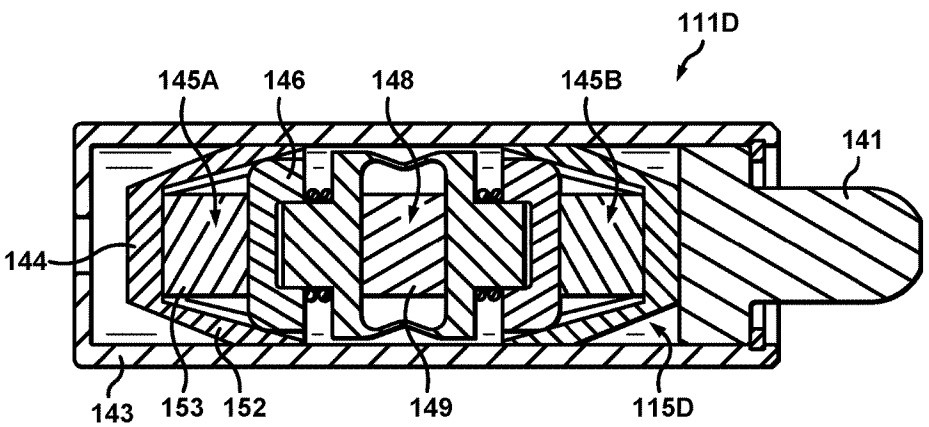
FIG. 4D is a cross-sectional view of the electromechanical lash adjuster of FIG. 4B in an extended configuration.
Figure 4F:
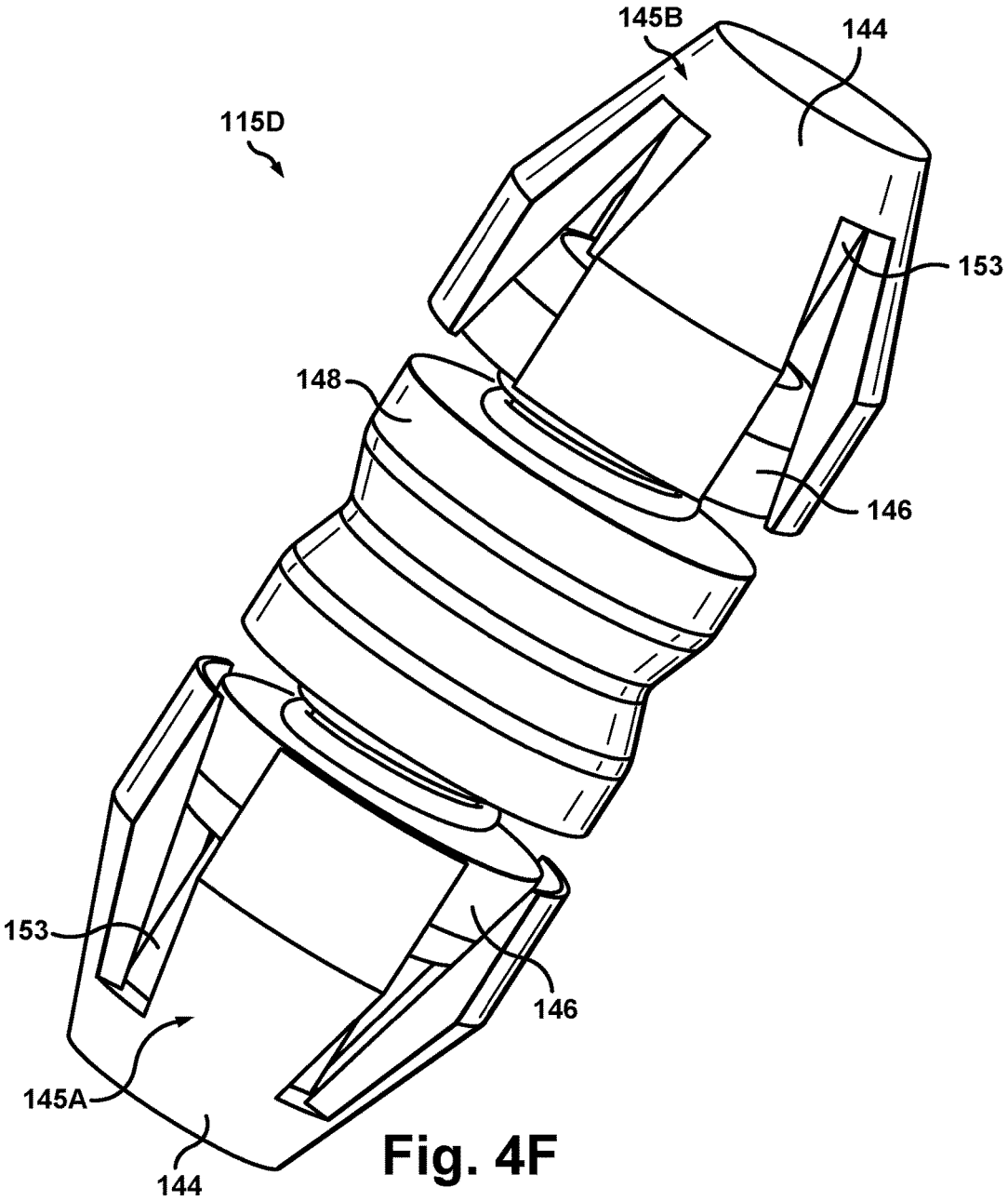
FIG. 4F is a perspective view of an electromechanical actuator that is in accordance with some aspects of the present teachings and is used in the electromechanical lash adjuster of FIGS. 4B-4E.

FIG. 4B-4E provide additional views of electromechanical lash adjuster 111D. FIGS. 4B and 4C show lash adjuster 111D in a contracted configuration whereas FIGS. 4D and 4E show it in an extended configuration. FIG. 4F provides a perspective view of actuator 115D. As shown by these figures, actuator 115D includes a first end portion 145A and a second end portion 145B joined by a variable length central portion 148. The length of central portion 148 may be controlled through a piezoelectric element 149.

Each of the end portions 145 includes a resilient element 144, a mandrel element 146, and a piezoelectric element 153. Resilient element 144 may be made of metal and may include struts 152 that are configured such that biasing resilient element 144 against mandrel element 146 causes struts 152 to bear against the bore of lower part 143, increasing friction between those parts and effectively locking the position of end portion 145 within the bore of lower part 143. The biasing force may be provided by either a piezoelectric element 153 or by a mechanical force that tends to compress lash adjuster 111D. In the absence of a sufficient biasing force, resiliency causes struts 152 to pull away from firm contact with the bore of lower part 143, which may release end portion 145 from locking engagement and allowing it to slide within the bore of lower part 143.

Figure 5:
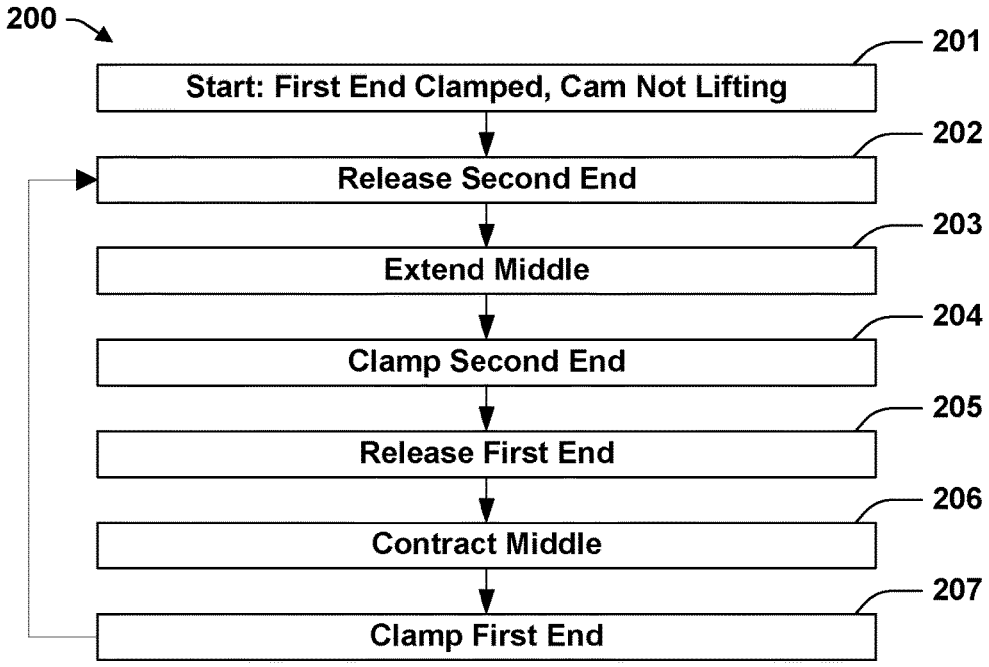
FIG. 5 is a flow chart of a method used in some aspects of the present teachings

FIG. 5 provides a flow chart of a method 200 through which engine 100D may be operated. Method 200 begins with step 201, which verifies that first end portion 145A is in a locking configuration and that cam 104D is on base circle or otherwise in a position where it is not significantly loading lash adjuster 111D. Method 200 proceeds with act 202, releasing second end portion 145B from its locking configuration. This may involve changing a voltage applied to a piezoelectric element 153. Next, act 203 extends middle portion 148. This operation may involve changing a voltage applied to piezoelectric element 149. Next, act 204 transitions second end portion 145B into a locking configuration. Next, act 205 releases first end portion 145A from its locking configuration. Act 206 is the reverse of act 203 and causes middle portion 148 to return to its contracted configuration. Act 207 returns first end portion 145A to its locking configuration. These steps may be repeated to extend electromechanical lash adjuster 111D in a series of increments. The order of these steps may be changed to contract lash adjuster 111D. Adjustment may be suspended while cam 104D is loading lash adjuster 111D. When cam 104D is applying a load to lash adjuster 111D, that load may drive both first end portion 145A and second end portion 145B into their locking configurations.

One or more of the piezoelectric elements of lash adjuster 111D may undergo periodic loading in conjunction with normal operation of rocker arm assembly 109D. This loading and unloading produces voltage differentials across these piezoelectric elements. The produced voltages may be detected for diagnostic or control purposes. In addition, these voltages may be tapped, whereby these piezoelectric elements are operative as generators. The electricity may be temporarily stored and subsequently used to operate lash adjuster 111D or power a controller for it.

Figure 6A:
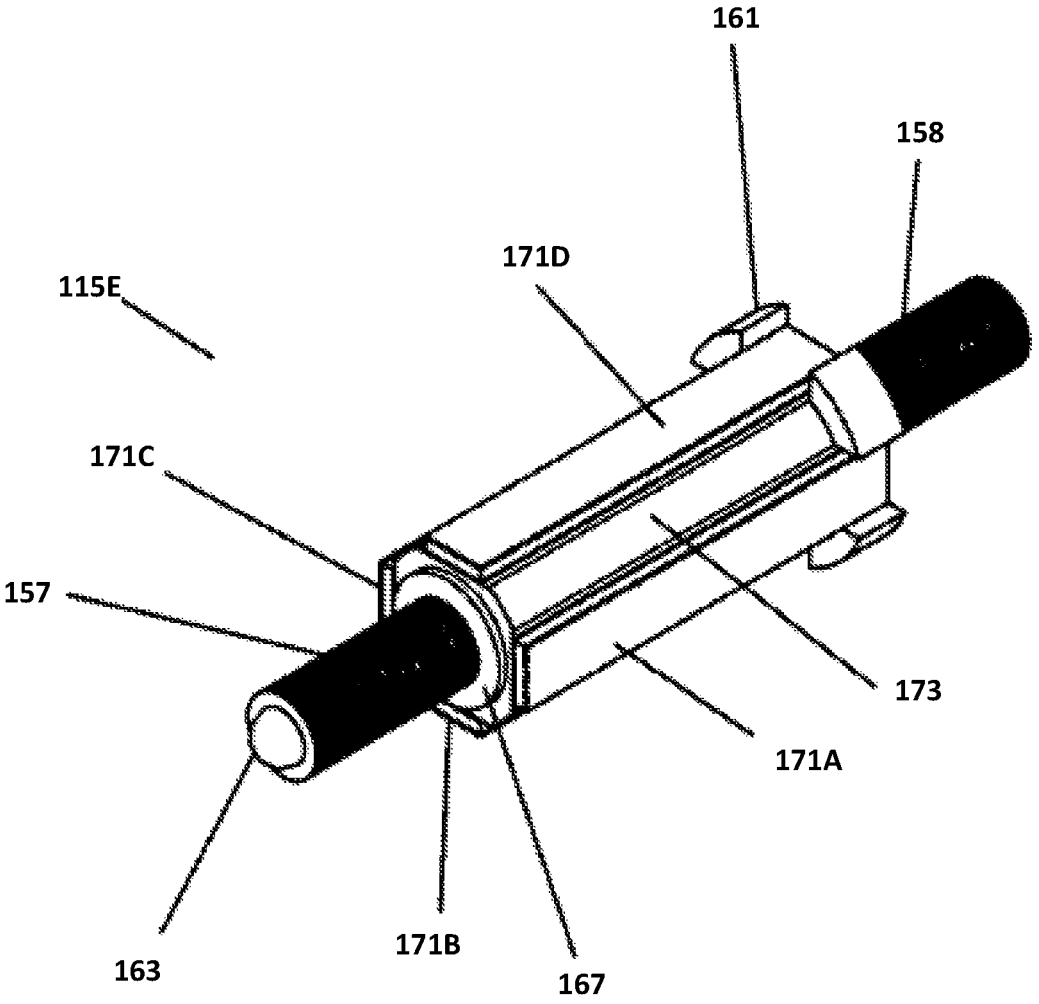
FIG. 6A is a perspective view of an electromechanical actuator that may be used in accordance with some aspects of the present teachings.
Figure 6B:
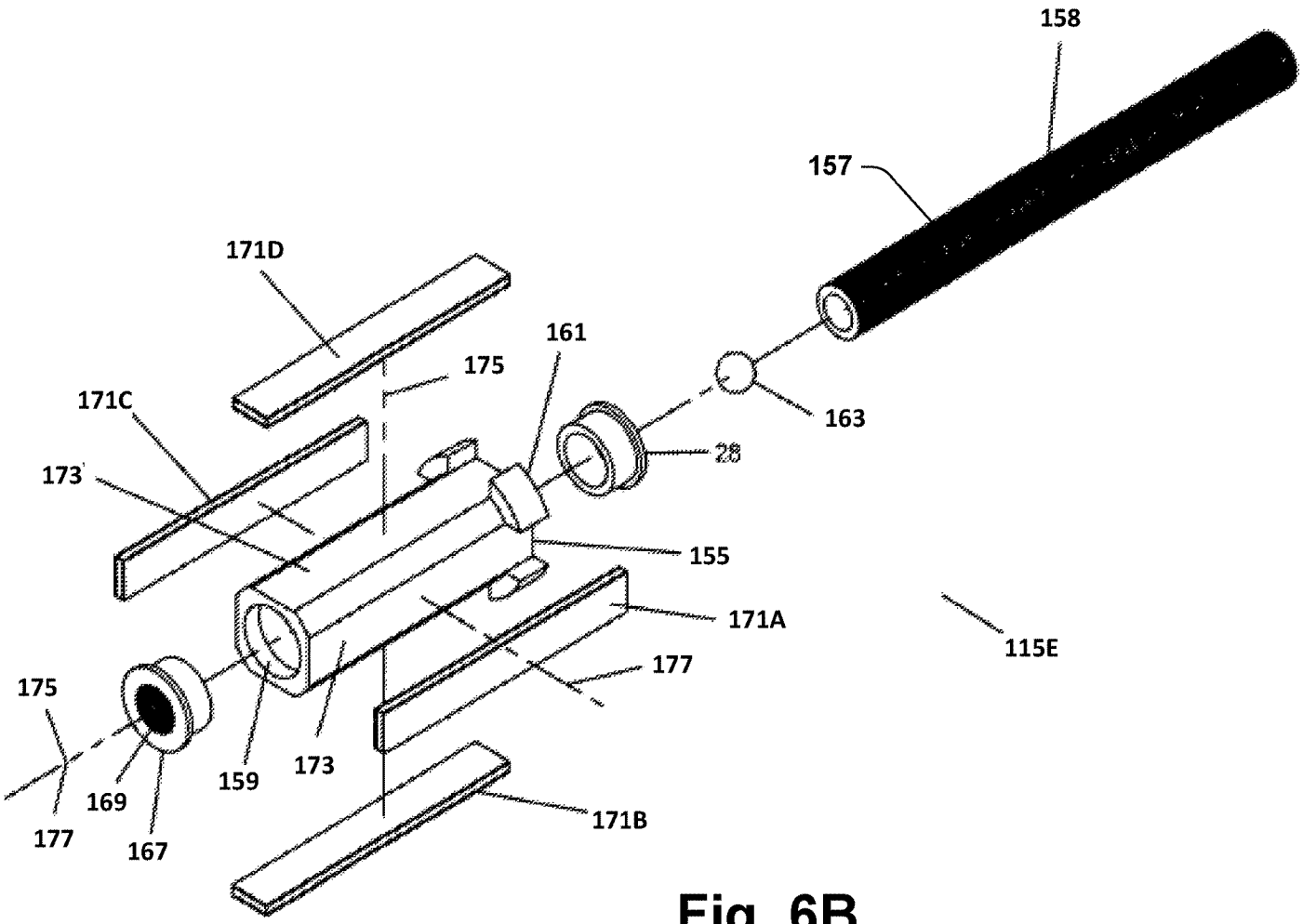
FIG. 6B is an exploded view of the actuator of FIG. 6A.

FIGS. 6A-B illustrate an electromechanical actuator 115E that may be used in place of electromechanical actuator 115A in engine 100A or in place of electromechanical actuator 115D in engine 100D. FIG. 6A provides a perspective view of actuator 115E and FIG. 6B provides an exploded view. Actuator 115E includes a housing 155. A nut 167 may be secured within an orifice 159 at one end of housing 155. Nut 167 has internal threads 169 that engage external threads 158 on shaft 157. A guide bushing 179 having a small clearance around shaft 157 may be secured at the opposite end of housing 155. At that opposite end, housing 155 may have flanges 161 through which housing 155 may be braced to a lower part 143 such as the one shown in FIG. 4A or otherwise held stationary relative to cylinder head 101. A spherical ball tip 163 or other end piece on threaded shaft 157 may provide a fulcrum for a rocker arm 106 or may be positioned to act against an upper part 141 such as the one shown in FIG. 4A that provide a fulcrum for the rocker arm 106.

Four piezoelectric plates 171 are bonded to outside surfaces 173 of housing 155. Plates 171 are positioned and operative to excite motion of housing 155 in the two orthogonal planes 175 and 177. The number and structure of piezoelectric elements 171 may be varied provided the elements 171 are operative to excite motion of housing 155 in planes 175 and 177. Piezoelectric plates 171 are operated through electrodes (not shown). Piezoelectric plates 171 may be driven with a frequency suitable to induce vibration of housing 155 and nut 167 at a resonant frequency in the ultrasonic range.

Figures 6C, 6D, 6E, 6F, 6G:
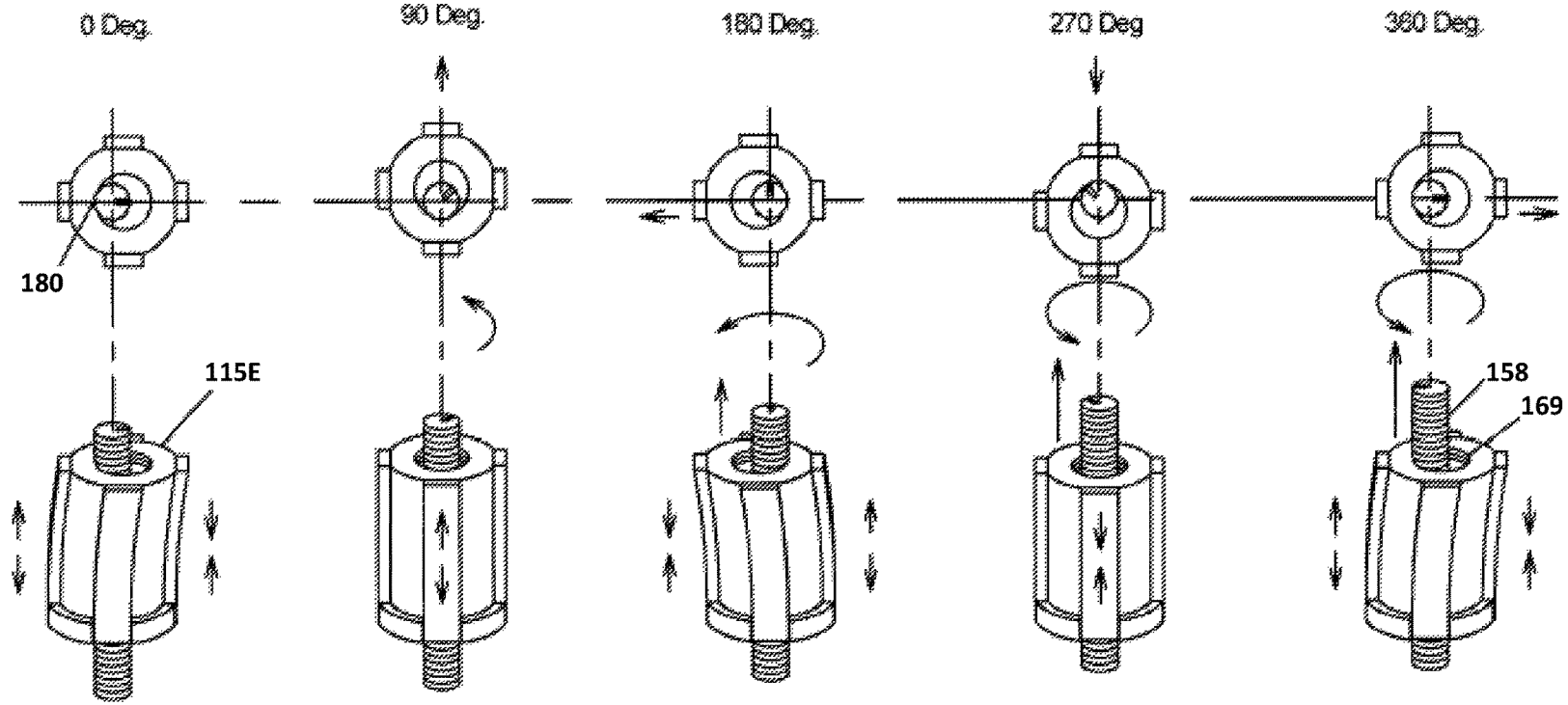
FIGS. 6C-6G are a series of drawings illustrating the operation of the actuator of FIG. 6A.

As shown in FIG. 6C, exciting vibration of housing 155 and nut 167 in planes 175 and 177 with the vibrations 90-degrees out of phase is operative to induce torque between nut 167 and shaft 157 and cause nut 167 to travel along shaft 157. There is a small clearance between the threads 169 of nut 167 and the threads 158 of shaft 157. The size of this clearance is exaggerated in the images of FIG. 6C. The series of images in FIG. 6C shows how the bending of plates 171 causes an area of contact between threads 169 and threads 158 to rotate about shaft 157. This causes nut 167 to orbit shaft 157 and, with friction, generates the torque. Shaft 157 may be driven either upward or downward depending on the phase relationship between the orthogonal modes of vibration. Operation of actuator 115E may be enhanced by isolating actuator 115E from oil in the environment surrounding lash adjuster 111. That isolation may be accomplished by enclosing actuator 115E within a telescopically engaged upper part 141 and a lower part 143 like actuator 115D as shown in FIG. 4A.

Figure 7:
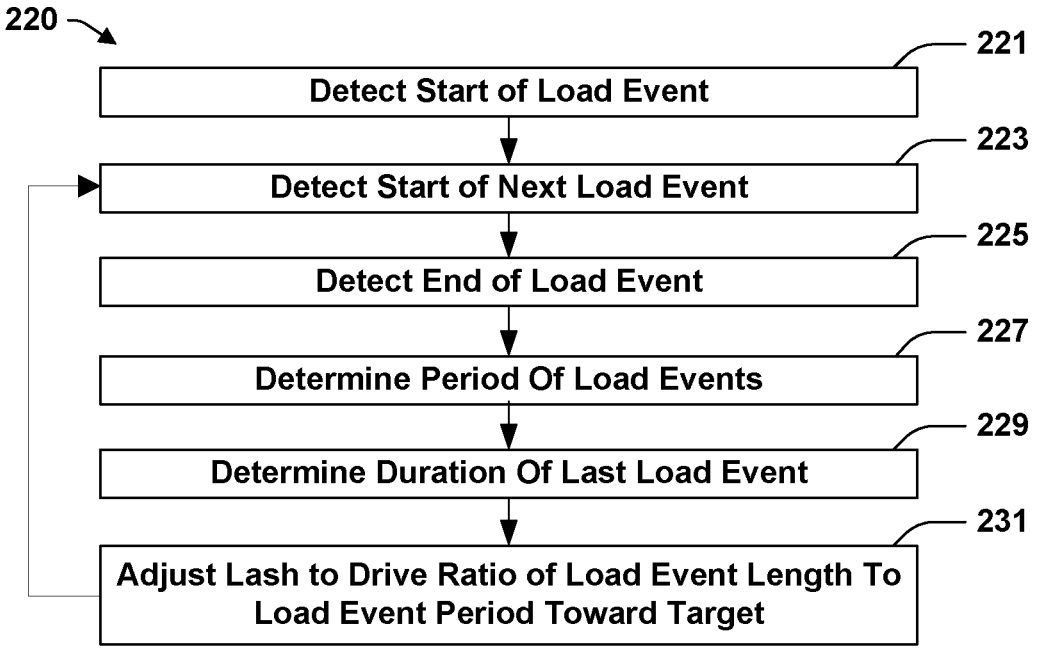
FIG. 7 is a flow chart of a method according to some aspects of the present teachings.

FIG. 7 provides a flow chart of a method 220 for controlling valve timing in an engine 100 that uses an electromechanical lash adjuster 109. Method 220 may be used to set the opening time for a valve 102 that controls either an intake or an exhaust port. By applying the method 220 to a pair of valves 102 controlling intake and exhaust ports of a single cylinder, the amount of overlap between the opening periods for those valves may be set to a pre-determined value.

Method 220 involves detecting the beginnings and endings of load events on a rocker arm assembly 109. The presence or absence of such a load event can be determined based on whether the load on a lash adjuster 109 exceeds a critical value. The load may be detected by a load cell 113 such as shown in FIG. 3 or by a suitably positioned piezoelectric element such as piezoelectric element 145B shown in FIG. 4A. Alternatively, the presence of a load exceeding the critical valve can be inferred from a displacement of poppet valve 102, which may be detected by any suitable sensor.

Method 220 begins with acts 221 and 223, detecting the beginnings of two consecutive load events, and act 225, detecting the end of a load event. Act 227 determines the period between load events. In this example, the determination is based on the interval between the starts of the preceding two load events. Alternative methods for calculating this period include determining the interval between the ends of two consecutive load events and more complicated methods that use additional load data to make a more accurate determination. Act 229 determines the duration of the last load event. Act 231 is operating the electromechanical lash adjuster 109 to drive a ratio between the load event duration and the load event period toward a target value. Method 220 may then return to act 223 and repeat.

One possible variation on method 220 is to use the time between load events in place of the load event period. The length of time between load events may be determined as the interval between the start of a load event and the end of the preceding load event. A ratio of the length of the interval between load events and the load event period is another alternative metric that may be used without changing the effect of method 220.

Figure 8A:
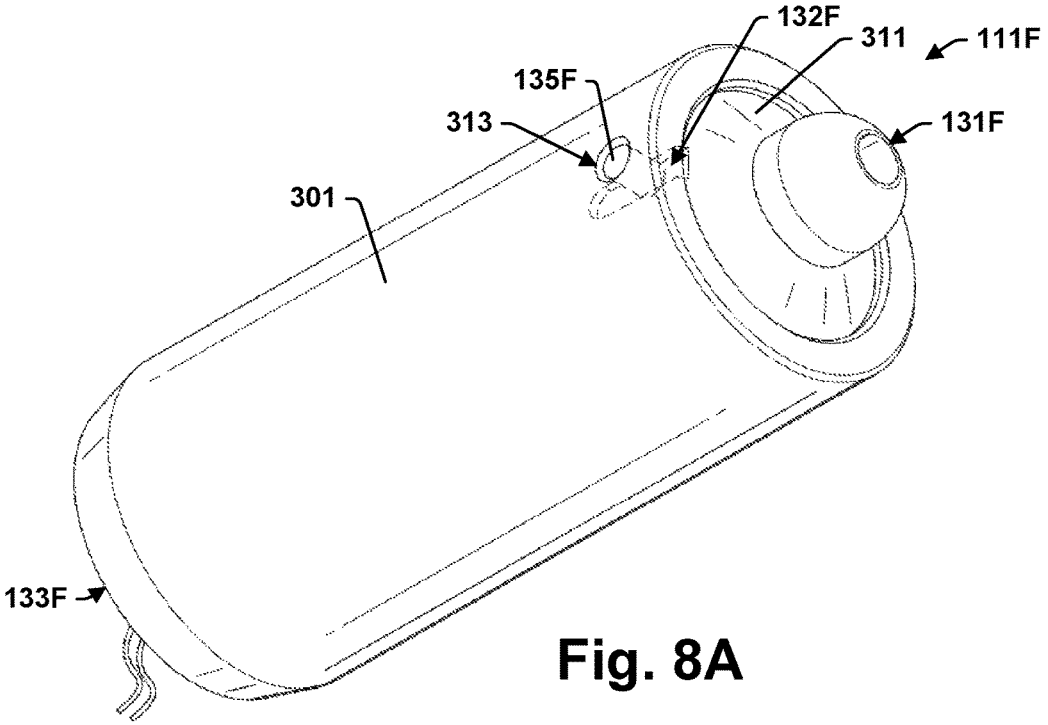
FIG. 8A is a perspective view of an electromechanical lash adjuster according to some aspects of the present teachings in a retracted configuration.
Figure 8B:
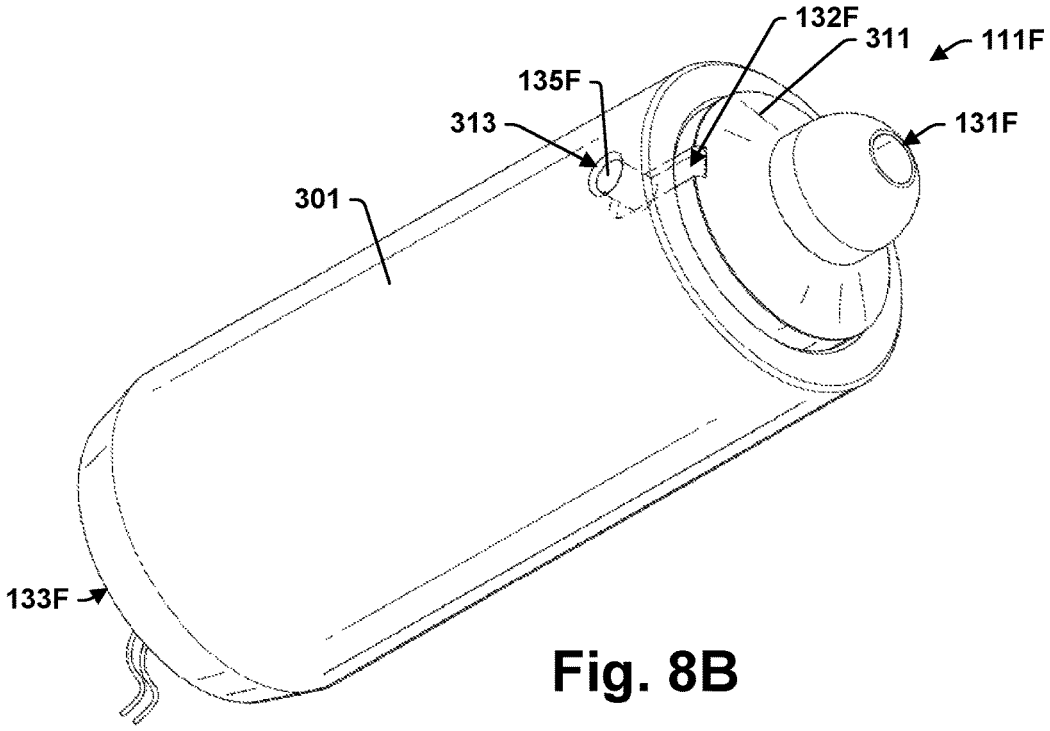
FIG. 8B is a perspective view of the electromechanical lash adjuster of FIG. 8A in an extended configuration.
Figure 8C:
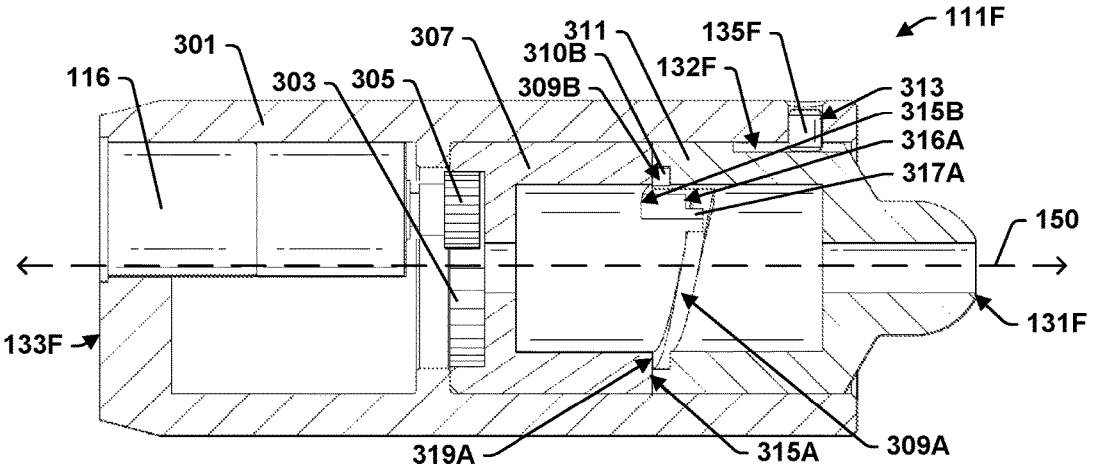
FIG. 8C is a cross-sectional view of the electromechanical lash adjuster of FIG. 8A in a retracted configuration.
Figure 8D:
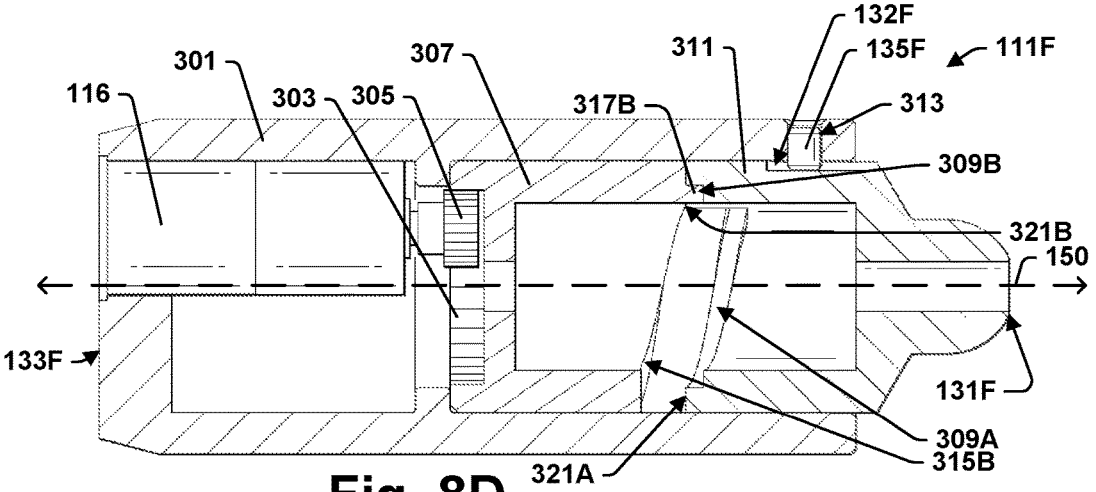
FIG. 8D is the same view as FIG. 8C but with the electromechanical lash adjuster in an extended configuration.

FIG. 8A-8D illustrate an electromechanical lash adjuster 111F according to some aspects of the present teachings. Lash adjuster 111F may be used in place of lash adjuster 111A in engine 100A or in place of lash adjuster 111D in engine 100D. Referring to FIGS. 8C and 8B, lash adjuster 111F includes two parts, lower part 307 and upper part 311, that are positioned end-to-end within an outer body 301 in a configuration that permits their relative rotation about axis 150, which is through the center of lash adjuster 111F. Lower part 307 and upper part 311 interface through abutting end surfaces 319 and 315, which are angled such that relative rotation between these parts on axis 150 causes a linear displacement between them along that axis. This capability for linear displacement makes lash adjuster 111F extensible and continuously variable in length between a first end 133F and a second end 131F thereof. End 133F is adapted to fit within a bore in cylinder head 101 and end 131F is adapted to provide a fulcrum for a rocker arm 106.

Lower part 307 has radial symmetry with two repeating units. Each unit provides a surface 315 that faces upper part 311, has a generally flat profile, and angles upward at a slope of 8-10° with respect to axis 150 through most of its 180° arc length. At its uppermost extent, surface 315 has a short flat region 316 out of which there is a protrusion 317 that may have a square cross-section. Protrusion 317 is shaped to ride within a channel 309 formed in upper part 311. Channel 309 has an arc length that is somewhat less than 180°. Protrusion 317 is adapted to ride freely with channel 309 under relative rotation between upper part 311 and lower part 307 until protrusion 317 encounters an end surface 310 of channel 309. Protrusion 317 cooperates with channel 309 to provide rotation-limiting stops.

Upper part 311 also has, for the most part, radial symmetry with two repeating units. Each unit provides a surface 321 that faces lower part 307, has a generally flat profile except for channel 309, and angles with respect to axis 150 with the same slope as surface 315 through most of surface 321's 180° arc length.

The radial symmetry of upper part 311 is broken by a slot 132F formed in upper part 311. A pin 133F fits through a bore in outer body 301 and rides within slot 132F to prevent upper part 311 from rotating relative to outer body 301. Motor 116 is secured to outer body 301 so that upper part 311 does not rotate relative to motor 116.

A pinion gear 303, which is an annular gear having inward facing teeth, is formed into lower part 307, whereby it is approximately the largest gear that can be fit within outer body 301. Motor 116 is positioned off axis 150 within outer body 301 so that motor 116 can directly drive a small gear 305 that meshes with pinion gear 303. Using a small number of simple parts all fitting within outer body 301, this arrangement provides a high gear ratio between motor 116 and lower part 307 the rotation of which is driven by motor 116.

Lash adjuster 111F has stiffness under load. Lash adjuster 111F resists compression under load through friction. As the load of rocker arm 109 on lash adjuster 111F increases, the friction force between surfaces 315 and 319 remains larger than the torque that load introduces between parts 307 and 311 due to the angled interface between those surfaces. A slope of 10 degrees is approximately the greatest these surfaces can have without providing one or both of surfaces 315 and 319 with a high friction material such as one of the high friction material used in transmissions.

In some aspects of the present teachings, in order to maintain a desired range of motion for lash adjuster 111F and to maintain its stiffness under load without requiring high friction materials, lash adjuster 111F does not have radial symmetry. In this alternative configuration, upper part 311 has a surface 321 that interfaces with part 307 and is continuously sloping with respect to axis 150 through a radial arc in the range from 225 to 360 degrees. In some of these teachings, the slope of that surface is in the range from 4 to 7 degrees.

The components and features of the present disclosure have been shown and/or described in terms of certain embodiments and examples. While a particular component or feature, or a broad or narrow formulation of that component or feature, may have been described in relation to only one embodiment or one example, all components and features in either their broad or narrow formulations may be combined with other components or features to the extent such combinations would be recognized as logical by one of ordinary skill in the art.

The invention claimed is:

1. An internal combustion engine, comprising:

a cylinder head in which is formed a cylinder;

a poppet valve for the cylinder having a seat within the cylinder head;

a cam shaft on which is mounted an eccentrically shaped cam; and a rocker arm assembly comprising a cam follower and a rocker arm; and an electromechanical lash adjuster comprising an electromechanical actuator, a first end, a second end, and a length between the first end and the second end;

wherein the first end provides a fulcrum for the rocker arm assembly;

the second end is supported by the cylinder head;

the electromechanical actuator is operative to forcibly extend the length between the first end and the second end;

the cam follower is positioned to engage and follow the eccentrically shaped cam as the cam shaft rotates; and the rocker arm assembly is operative to form a first force transmission pathway through which force from the eccentrically shaped cam is transmitted to the poppet valve to actuate the poppet valve.

2. An internal combustion engine according to claim 1, wherein:

the electromechanical lash adjuster comprises a first part and a second part;

the electromechanical actuator is configured to rotate one of the first and second parts relative to the other about an axis;

the first and second parts interface through one or more surfaces that are angled such that relative rotation between the first and second parts about the axis causes a linear displacement between the first and second parts along the axis to vary; and the electromechanical lash adjuster is operative as a linear actuator that varies the length between the first end and the second end in relation to relative rotation between the first and second parts.

3. An internal combustion engine according to claim 2, wherein the electromechanical actuator comprises an electromagnetic motor that is housed within an outer body of the electromechanical lash adjuster and has a spindle that is parallel to, but offset from, the axis.

4. An internal combustion engine according to claim 2, wherein the one or more surfaces through which the first and second parts interface are formed through helical threads on one or both of the first part and the second part.

5. An internal combustion engine according to claim 2, wherein the one or more surfaces through which the first and second parts interface between the first part and the second part are formed in part by an angled end surface of one or the other of the first part and the second part.

6. An internal combustion engine according to claim 2, wherein:

the electromechanical lash adjuster further comprises a third part;

the electromechanical actuator is configured to rotate the second part about the axis and relative to the first part and the third part;

the second part interfaces with the third part through one or more surfaces that are angled such that relative rotation between the second part and the third part about the axis causes a linear displacement between the second part and the third part along the axis to vary; and the electromechanical lash adjuster is operative as a linear actuator that varies the length between the first end and the second end in relation to linear displacement between the first part and the third part.

7. An internal combustion engine according to claim 2, wherein:

the electromechanical actuator comprises a piezoelectric element; and the electromechanical actuator is structured such that the piezoelectric element is operative to induce torque between the first part and the second part.

8. An internal combustion engine according to claim 1, wherein the electromechanical actuator is operative to vary the length between the first end and the second end through a clamp-extend-clamp-retract mechanism.

9. An internal combustion engine according to claim 1, wherein the electromechanical lash adjuster is operable over a range of extension through which it resists compression along its length primarily through friction.

10. An internal combustion engine according to claim 9, wherein the electromechanical lash adjuster is structured whereby the friction force that resists compression increases as load on the electromechanical lash adjuster increases.

11. An internal combustion engine according to claim 1, wherein:

the rocker arm assembly comprises an auxiliary rocker arm;

the rocker arm and the auxiliary rocker arm are pivotally linked to form a joint proximate the fulcrum; and the auxiliary rocker arm has an end distal from the joint and mounted at a position that is substantially fixed relative to the cylinder head.

12. An internal combustion engine according to claim 1, further comprising:

a generator mounted to or forming a part of the electromechanical lash adjuster;

wherein the electromechanical actuator is configured to be powered by energy produced by the generator.

13. An internal combustion engine according to claim 1, wherein the electromechanical actuator is housed within an outer body of the electromechanical lash adjuster.

14. An internal combustion engine according to claim 1, wherein the eccentrically shaped cam lacks a base circle structure.

15. A method of operating an internal combustion engine according to claim 1, comprising:

collecting data relating to a timing with which the eccentrically shaped cam is applying a force to or inducing a displacement in the poppet valve or a component of the rocker arm assembly; and operating the electromechanical actuator to adjust lash in the first force transmission pathway on the basis of the data relating to the timing.

16. A method of operating an internal combustion engine according to claim 1 comprising:

detecting force on a piezoelectric element of the electromechanical actuator to provide a force detection; and using the force detection to provide diagnostic information or feedback control;

wherein the piezoelectric element is also used to effectuate lash adjustment.

17. The method of claim 16, wherein the piezoelectric element is operative to detect vibrations and the diagnostic information relates to wear.

18. An internal combustion engine, comprising:

a cylinder head in which is formed a cylinder;

a poppet valve for the cylinder having a seat within the cylinder head;

a cam shaft on which is mounted an eccentrically shaped cam; and a rocker arm assembly comprising a cam follower and an electromechanical lash adjuster;

wherein the electromechanical lash adjuster comprises a first end, a second end, a length between the first end and the second end, and an electromechanical actuator operative to forcibly increase the length between the first end and the second end;

the first end provides a fulcrum for the rocker arm assembly;

the second end is supported by the cylinder head;

the cam follower is positioned to engage and follow the eccentrically shaped cam as the cam shaft rotates; and the rocker arm assembly is operative to form a first force transmission pathway through which force from the eccentrically shaped cam is transmitted to the poppet valve to actuate the poppet valve.

19. An internal combustion engine according to claim 18, wherein:

the electromechanical lash adjuster comprises a first part and a second part;

the electromechanical actuator is configured to rotate one of the first and second parts relative to the other about an axis;

the first and second parts interface through one or more surfaces that are angled such that relative rotation between the first and second parts about the axis causes a linear displacement between the first and second parts along the axis to vary; and the electromechanical lash adjuster is operative as a linear actuator that varies the distance between the first end and a second end of the electromechanical lash adjuster in relation to relative rotation between the first and second parts.

20. A valvetrain for an internal combustion engine of a type that includes a cylinder head in which is formed a cylinder, a poppet valve for the cylinder having a seat within the cylinder head, the valvetrain comprising:

a cam shaft on which is mounted an eccentrically shaped cam;

a rocker arm assembly comprising a cam follower and a rocker arm; and an electromechanical lash adjuster having, a first end, a second end, and a length between the first end and the second end;

wherein the first end provides a fulcrum for the rocker arm assembly;

the second end is supported by the cylinder head; and the electromechanical lash adjuster is an electrically powered linear actuator.

* * * * *